US006224454B1

(12) United States Patent
Cheng et al.

(10) Patent No.: US 6,224,454 B1
(45) Date of Patent: May 1, 2001

(54) DYNAMIC SEARCHING DEVICE FOR TOYS

(76) Inventors: Jer-Ming Cheng; Tsou Hsien Chih, both of 18F-2, No.2, Lane 175, Sec.3, Shiou-Lang Road, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/337,215

(22) Filed: Jun. 18, 1999

(51) Int. Cl.[7] ..... A63H 17/26
(52) U.S. Cl. ..... 446/175; 446/441; 446/460
(58) Field of Search ..... 446/175, 409, 446/441, 442, 457, 460, 465

(56) References Cited

U.S. PATENT DOCUMENTS 2,832,426 * 4/1958 Seargant ..... 446/175
3,406,481 * 10/1968 Tachi ..... 446/175
3,782,031 * 1/1974 Byron .
3,849,931 * 11/1974 Gulley, Jr. ..... 446/175
4,085,542 * 4/1978 Mitamura ..... 446/175
4,086,724 * 5/1978 McCaslin ..... 446/175
4,245,430 * 1/1981 Hoyt .
4,662,854 * 5/1987 Fang ..... 446/175
4,874,343 * 10/1989 Rosenthal ..... 446/175
4,938,483 * 7/1990 Yavetz ..... 446/175
4,987,349 * 1/1991 Nakamura ..... 446/175
5,630,743 * 5/1997 Shi ..... 446/175
5,847,854 * 12/1998 Benson, Jr. ..... 446/175

* cited by examiner

*Primary Examiner*—Jacob K. Ackun
*Assistant Examiner*—Jeffrey D. Carlson
(74) *Attorney, Agent, or Firm*—Dougherty & Troxell

(57) ABSTRACT

The present invention provides a dynamic searching device for toys, having at least two optical sensors to sense a target and a control circuit to compare the sensed signals of the two sensors and control a driver to move the toy, thus giving the toy dynamic movement.

8 Claims, 3 Drawing Sheets

DYNAMIC SEARCHING DEVICE FOR TOYS

BACKGROUND OF THE INVENTION (a) Field of the Invention

The present invention relates to a dynamic searching device for toys.

(b) Description of the Prior Art

Many toys are often driven by mechanical devices to control the motion thereof, such as toy vehicles. However, the toys are generally controlled by remote control, and lack spontaneous and automatic movement and interactive operation. Compared to the fast development of interactive games, such as computer games, the conventional mechanical toys are relatively dull and cannot attract children.

SUMMARY OF THE INVENTION

The present invention is intended to provide a dynamic searching device for toys, which comprises at least two optical sensors to sense a target and a control circuit to compare the sensed signal of the two sensors and control a driver to move the toys with the sensor, thus giving the toys dynamic movement.

It is another object of the present invention to give the toys dynamic simulation effects by adding more movement or visual effect to the toys when the sensor is sensing the right target.

It is another object of the present invention to provide a dynamic searching device which can use sensors other than optical sensors.

The various objects and advantages of the present invention will be more readily understood from the following detailed description when read in conjunction with the appended drawing, in which:

DETAILED DESCRIPTION OF THE PREFERRED EMBODIMENT

Figure 1:
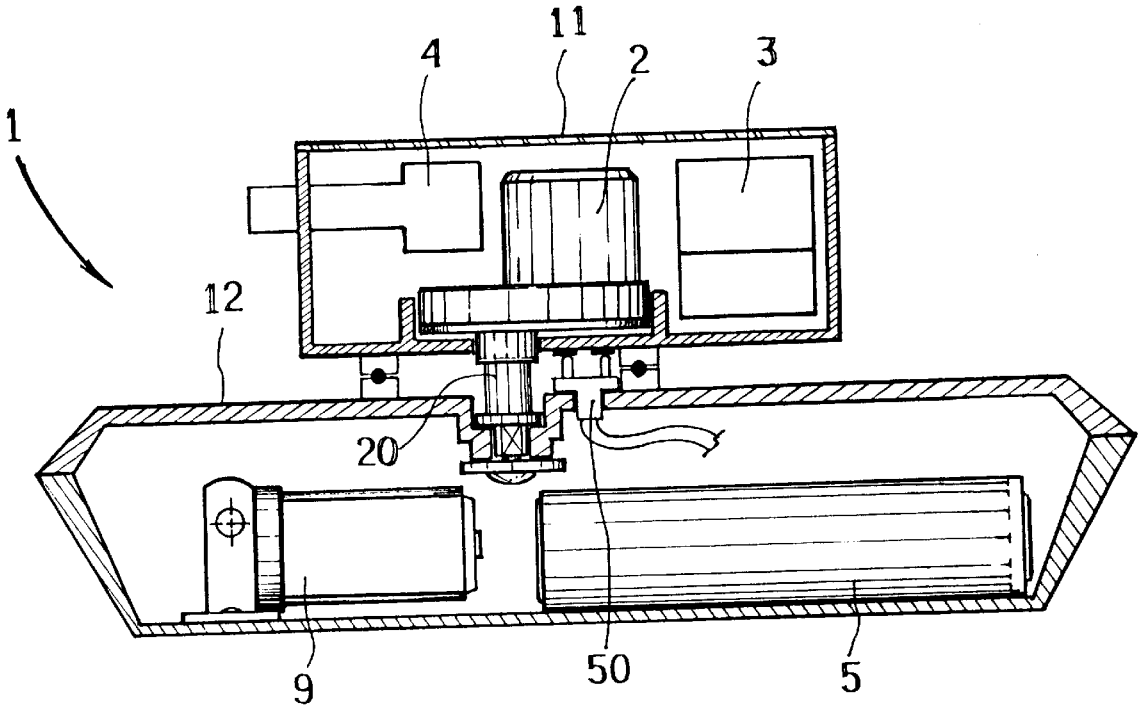
FIG. 1 is the cross sectional view of the present invention.

As shown in FIG. 1, the dynamic searching device for toys according to the present invention comprises a main body 1 having a rotary stage 11 and a base 12, a driver 2, a control circuit 3, an optical sensor 4, and a power source 5. The rotary stage 11 and the base 12 are connected through a link shaft 20 driven by the driver 2. The control circuit 3 sends commands to the driver 2 with reference to the sensed result of the sensor 4.

Figure 2:
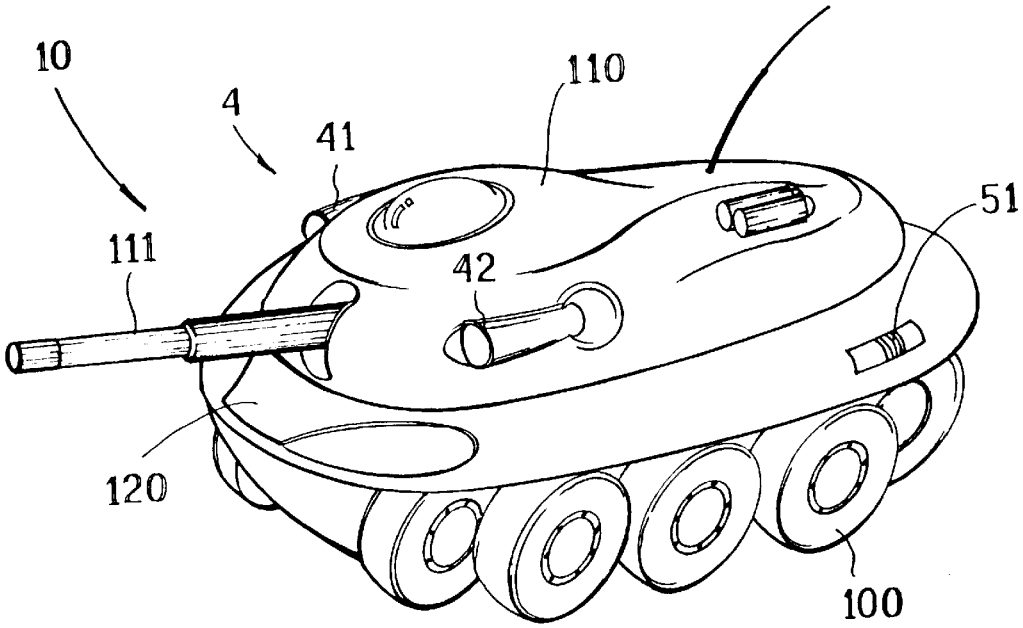
FIG. 2 is the perspective view of the present invention.

With reference now to FIGS. 1 and 2, in the tank 10 according to a preferred embodiment, the rotary stage 11 is the turret 110 of the tank, the base 12 is the carrier 120 of the tank, the optical sensor 4 is a pair of sensors 41 and 42 parallel to each other and arranged on both sides of the turret 100. Moreover, for providing 3-D searching effect, three sensors may be provided. A gun 111 is arranged at the center of the turret 110. The turret 10 can rotate to aim at the sensed target, therefore the tank 10 provides interactive amusement.

Figure 3:
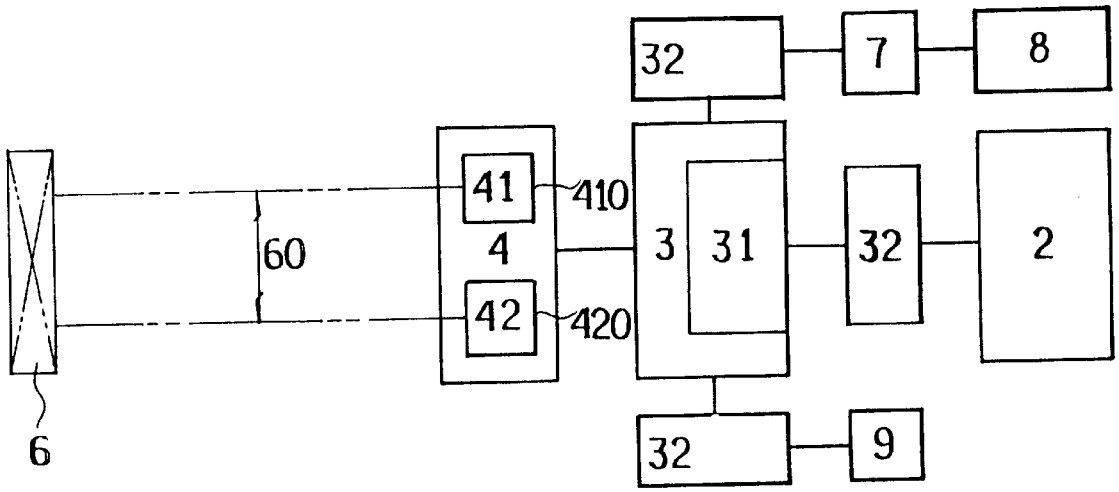
FIG. 3 is the circuit diagram of the present invention.

The two sensors 41 and 42 are of the same operational wavelength and the target 6 to be detected is monochromatic. For examples, the military car is green color, the building is brown. The separation 60 between the two light axes 61 and 62 of the two sensors 41 and 42 is smaller than the size of the target 6. The sensed results of the sensors 41 and 42 are sent to a comparator 31 and amplified by an amplifier 32, then sent to the driver 2. As shown in FIGS. 2 and 3, after the power switch 51 is turned on, the turret 110 begins rotating to search for target 6. The sensed results of the sensors 41 and 42 are different if the turret 110 does not aim at the right target. The comparator 31 sends an output signal corresponding to this result and the turret 110 keep rotating. The sensed results of the sensors 41 and 42 are the same if the turret 110 aims at the right target. The comparator 31 sends an output signal corresponding to this result and the turret 110 stops rotating.

Moreover, after the right target is aimed, the control circuit 3 activates an audio means 7 to raise a sound of gun shot and activates an auxiliary means 8 which provides a kick effect to the tank 10.

Furthermore, the tank 10 has a motor 9 within the carrier 120 driving the wheels 100 under the carrier 120. At the beginning, the comparator 31 sends an output signal corresponding to not-finding target, and commands the motor 9 to keep the carrier 120 moving. After the gun is aimed, the comparator 31 sends an output signal corresponding to finding the target, and commands the motor 9 to stop the carrier 120. The motor 9 is a single polarity due to the straight movement of the carrier 120, and the rotary stage 11 is dual polarity because the turret 110 can rotate in clockwise or counter clockwise directions.

Moreover, the sensing range of the sensor 4 is limited to prevent wrong detection and ensure a sensing region. In other words, the sensor 4 will not detect an object out of the region of interest.

Figure 4:
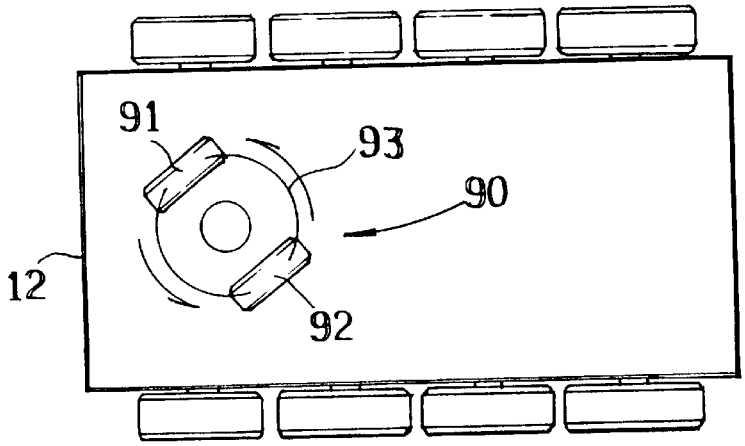
FIG. 4 is the bottom view of the present invention.

As shown in FIG. 4, the wheel driver of the motor 9 is a universal wheel-driver 90 wherein two wheels 91 and 92 are connected coaxially with the driving disk 93. Therefore, the carrier 120 will change its moving direction automatically once meeting an obstacle.

Furthermore, the sensor 4 in the present invention can also be an audio sensor or other type of sensor such as IR sensor or thermal sensor. For explanation, an audio sensor is taken for example and has two audio sensors 410 and 420 for detecting an audio signal. The sensors 410 and 420 are designed to detect predetermined audio data and find the direction of maximum audio source. For example, the dynamic searching device with sensors 410 and 420 are arranged in a movable baby toy which is looking for a target of mother. The target (mother) will raise a comforting sound once the baby toy has found it.

When using an audio sensor, various-frequency signals can be used such as high-frequency, low frequency audio signal or other frequency signal. The control circuit 3 is designed to be applicable to a signal of above frequency to trigger various auxiliary means, or an audio IC with corresponding audio sensor can be used.

Moreover, the present invention can use multiple types of sensors, e.g. audio and thermal sensor simultaneously to find multiple data, and the control circuit 3 is adapted to receive and process above multiple types of sensing data.

Figure 5:
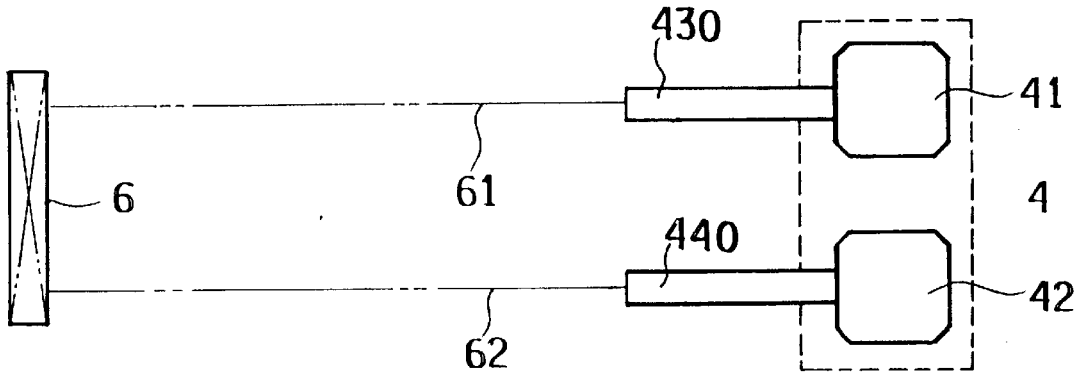
FIG. 5 is a view showing the sensor of the present invention.

As shown in FIG. 5, the sensor 4 further comprises two light guiding pipes 430 and 440 and the axes 61 and 62 such that the size of the target can be reduced and the dynamic searching device is applicable to a target of small size.

Figure 6:
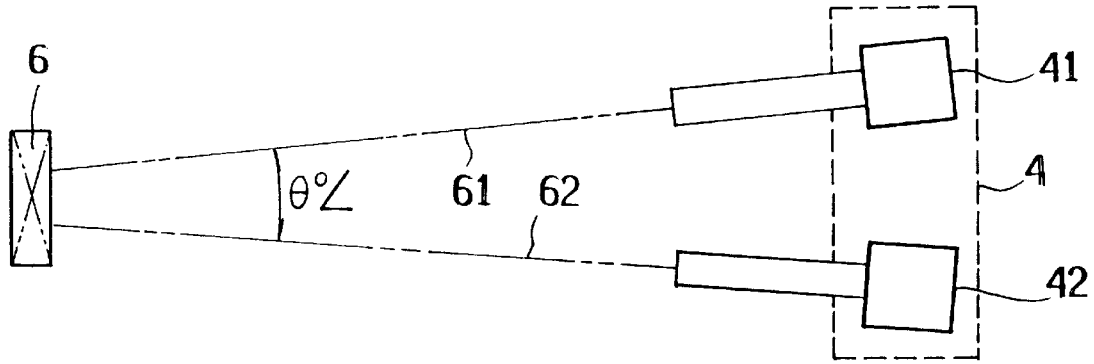
FIG. 6 is another view showing the sensor of the present invention.

Moreover, as shown in FIG. 6, the axes of the sensors 41 and 42 are inclined and intersected such that the size of the target 6 can be reduced and the dynamic searching device is applicable to a target of small size.

Moreover, the sensor of the present invention is designed to detect light of a specific wavelength for use in a combat game. For example, the two armies are featured with red and white color, and the sensors thereof can distinguish ally from enemy.

As shown in FIG. 1, a conductive terminal 50 is arranged between the base 12 and the rotary stage 11 and centered around the shaft 20. By the conductive terminal 50, the power source 5 can be more flexibly arranged and the inventive device can be scaled down.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A dynamic searching toy comprising:

a) a toy base having a plurality of wheels to movably support the toy base on a surface;

b) a rotary stage rotatably mounted on the toy base so as to rotate with respect to the toy base;

c) a plurality of spaced apart sensors on the rotary stage;

d) a first motor for rotating the rotary stage relative to the toy base;

e) a second motor for driving the wheels so as to move the toy base on the surface; and, f) a control circuit connected to the plurality of sensors, the first motor and the second motor, the control circuit including a comparator for comparing signals from the sensors such that, when the comparator receives signals from the sensors that are different from each other, the first and second motors are both actuated so as to move the toy base while the rotary stage rotates and, when the comparator receives signals from the sensors that are the same, both the first and second motors are deactivated so as to stop movement of the toy base and to stop rotation of the rotary stage.

2. The dynamic searching toy of claim 1 wherein the plurality of sensors comprise optical sensors.

3. The dynamic searching toy of claim 1 wherein the plurality of sensors comprise audio sensors.

4. The dynamic searching toy of claim 1 wherein the plurality of sensors comprise infrared (IR) sensors.

5. The dynamic searching toy of claim 1 wherein the plurality of sensors comprise thermal sensors.

6. The dynamic searching toy of claim 1 wherein each sensor has a sensing axis and the sensing axes are parallel to each other.

7. The dynamic searching toy of claim 1 wherein each sensor has a sensing axis and the sensing axes extend obliquely with respect to each other.

8. The dynamic searching toy of claim 1 wherein the control circuit further comprises an audio device which is activated after the toy base has stopped moving and the rotary stage has stopped rotating, the audio device is actuated to produce an audible sound.

* * * * *